US008015682B1

(12) United States Patent
Anders

(10) Patent No.: US 8,015,682 B1
(45) Date of Patent: Sep. 13, 2011

(54) METHOD AND DEVICE FOR FORCIBLE ENTRY

(76) Inventor: Lawrence Fred Anders, Phoenix, AZ (US)

( * ) Notice: Subject to any disclaimer, the term of this patent is extended or adjusted under 35 U.S.C. 154(b) by 0 days.

(21) Appl. No.: 12/815,353

(22) Filed: Jun. 14, 2010

Related U.S. Application Data

(60) Provisional application No. 61/339,096, filed on Mar. 1, 2010.

(51) Int. Cl.
*B25B 27/02* (2006.01)
*B23P 11/00* (2006.01)

(52) U.S. Cl. ..... 29/254; 29/272; 29/275; 29/25; 173/90

(58) Field of Classification Search ..... 29/254, 29/255, 270, 244, 252, 253, 272, 275; 254/93 R, 254/21, 25; 173/90
See application file for complete search history.

(56) References Cited

U.S. PATENT DOCUMENTS

| | | | | | |
|---|---|---|---|---|---|
| 4,783,053 | A * | 11/1988 | Yirmiyahu et al. | ..... | 254/93 R |
| 5,177,850 | A * | 1/1993 | Hull et al. | ..... | 29/254 |
| 5,329,685 | A * | 7/1994 | Gillespie | ..... | 29/254 |
| 5,398,773 | A * | 3/1995 | Baker | ..... | 173/90 |
| 5,732,932 | A * | 3/1998 | Michalo | ..... | 254/93 R |
| 6,035,946 | A * | 3/2000 | Studley et al. | ..... | 173/90 |
| 6,318,228 | B1 * | 11/2001 | Thompson | ..... | 89/1.14 |
| 6,631,668 | B1 * | 10/2003 | Wilson et al. | ..... | 89/1.14 |
| 7,490,813 | B1 * | 2/2009 | Weddle | ..... | 254/93 R |
| 7,707,700 | B1 * | 5/2010 | Lapetina | ..... | 29/25 |

* cited by examiner

*Primary Examiner* — Lee D Wilson
(74) *Attorney, Agent, or Firm* — Gary W. Malhoit

(57) ABSTRACT

A breaching device (100) includes an elongated main body (4) that forms an outer surface (2) and has a front end (24). The elongated main body (4) divides along a length and forms substantially equal upper (20) and lower (22) portions. A first curved handle (6) is attached to the outer surface (2) and extends a first height (21) over a portion of the upper portion (20). A partition (10) is attached to the outer surface (2) between the first curved handle (6) and the front end (24), and extends a second height (15) over the upper portion (20) and generally transverse to the length of the elongated main body (4). The second height (15) is greater than the first height (21).

12 Claims, 8 Drawing Sheets

METHOD AND DEVICE FOR FORCIBLE ENTRY

This non-provisional application claims the benefit of a prior-filed provisional application having the application number of 61/339,096. Filed Mar. 1, 2010

BACKGROUND OF THE INVENTION

The present invention relates, in general, to accessing the interior of buildings and dwellings and, more particularly, rapidly breaching a barrier to access the interior.

Various authorities including federal, local, state, the military and emergency medical units frequently require rapid access to the interior of structures such as houses, apartments, office buildings and the like. Quick access can be necessary to surprise criminal or terrorist occupants. In emergency situations, occupants can be endangered by fire or chemicals and need to be reached quickly. Hence, medical emergency respondents can require rapid access to provide medical assistance. Typically, the fastest method of gaining access to a structure is via a door, gate and the like, referred to hereafter as a barrier. Often the barrier is locked or does not open freely for various reasons. This can preclude rapid access. Hence, various methods and devices have been used to rapidly breach locked barriers. These methods can range from using charged explosive devices to employing ram devices.

Ram devices are used to strike the barrier and are applied to a target or a preferred sweet-spot referred to as the breach point. The success of rapidly breaching the barrier depends on correctly selecting the breach point. The selection of the breach point can depend on a number of factors such as the type of barrier, present physical state of the barrier, the location of underlying metal structures, the location of the barrier handle (e.g., door knob), the position of the hinges, obstructions adjacent to the barrier and the like. For example, selecting a breach point adjacent to a metal member can result in inadequately breaching the barrier. Quickly breaching the barrier is also highly dependent on the amount of energy transferred from the ram device to the breach point. The energy, or more particularly, the transferred kinetic energy is a function of the square of the velocity of the ram device. Hence, the kinetic energy imparted onto the barrier is substantially dependent on the velocity of the ram device on contacting the barrier.

In order to administer the ram device at the highest possible velocity, a user should secure an optimal grip to the ram device. Generally, a person's optimal handle grip takes place when a grip object's circumference is approximately equal to the distance from the tip of the third finger to the distal crease of the palm. Otherwise, a poor grip called either an under-grip or over-grip can occur when the grip object is too large or small, respectively. Further, the motion of the user's hand(s) typically continues with the ram device after penetration of the barrier. This can expose the user's hands to injury, resulting from contacting a portion of the barrier or at least a portion of a corner of an adjacent wall and the like. For at least this reason, the user normally has a tendency to be cautious due to the potential for hand injury. As a result, the user typically swings the ram device at a lower velocity, thereby not quickly penetrating the barrier in many situations.

Hence, there is a need for a ramming device that can be optimally gripped and safely swung at the highest possible velocity to rapidly penetrate a barrier.

SUMMARY OF THE INVENTION

In one general aspect of the invention, a breaching device includes an elongated main body that forms an outer surface and has a front end. The elongated main body divides along a length and forms substantially equal upper and lower portions of the outer surface. A first curved handle is attached to the outer surface and extends a first height over a portion of the upper portion of the outer surface. A partition is attached to the outer surface between the first curved handle and the front end, and extends a second height over the upper portion of the outer surface and generally transverse to the length of the elongated main body. The second height is greater than the first height.

In another general aspect, a breaching device includes an elongated main body and has an outer surface and a front end. A curved handle having a grip region and is attached to the outer surface. A curved partition is disposed on the outer surface. The partition is positioned with respect to the curved handle to substantially eclipse the grip region when viewed directly along the length of the elongated main body from the front end.

In yet another general aspect, a method of breaching a barrier includes providing a breaching device made from an elongated main body with a front end and having an outer surface, A curved handle having a grip region is attached to the outer surface. A curved partition is attached to the outer surface between the curved handle and the front end. The curved partition substantially eclipses the grip region when viewed directly along the length of the elongated main body from the front end. The front end of the breaching device is swung in a motion along an arc toward a breach point of a barrier. A center of the arc is generally disposed at a point adjacent to a wall. The barrier is penetrated using the front end. The curved partition impacts a surface adjacent to the barrier. The motion of the breaching device is stopped on the impact of the curved partition with the adjacent surface.

DETAILED DESCRIPTION OF THE DRAWINGS

Generally, the invention is a ram device used to breach a barrier and a method of using the breaching device. The ram device includes at least an elongated main body having an outer surface and a curved partition between the front end of the main body and a first curved handle. The first curved handle includes a gripping area. The curved partition extends a height above the first curved handle and generally blocks a view of the gripping area of the curved handle when viewed from the front end. The size and location of the curved partition in relation to the first curved handle generally precludes the user from injury, because the curved partition shields the grip region and protects the hand of the user. Further, the diameter of the curved handle is at least 1.25 inches and provides the user with the ability to maintain an optimal grip. The user is enabled to swing the ram device at the highest possible velocity, due to the optimal grip. By swinging the ram device at the highest realizable possible velocity, the barrier can be breached in the fastest possible time, because the maximum kinetic energy is transferred from the ram device to the barrier. This can significantly improve the likelihood of success, which is paramount in quickly breaching the barrier. A user swings the front end of the breaching device in a motion along an arc toward a breach point of a barrier. The breaching point is penetrated using the front end. Next, the curved partition impacts an adjacent surface, thereby stopping the motion of the breaching device. In addition to protecting the user from injury, the curved partition also provide a surface of contact for stopping the motion of the breaching device. The user swings the breaching device in an arc such that the center of the arc is generally disposed at a point adjacent to a wall.

Figure 1:
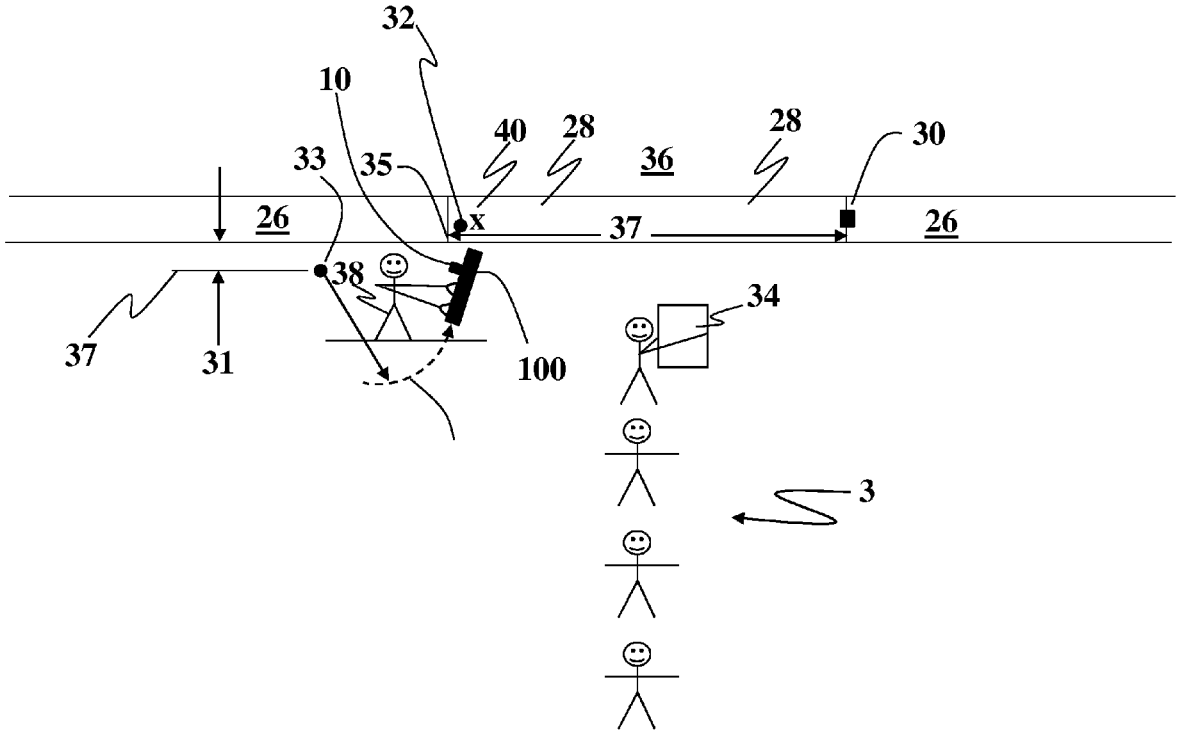
FIG. 1 is a schematic diagram for depicting the use of a breaching device.

The present invention will be better understood from a reading of the following detailed description, taken in conjunction, with the accompanying drawing figures, in which like reference numbers designate like elements and in which:

FIG. 1 is a schematic diagram illustrating a method of using a breaching device 100. A barrier 28 having a width 37 is depicted between two portions of a wall 26 and is connected to the wall 26 via hinges 30. A region of access 36 is shown above the barrier 28. A user 38 is depicted holding the breaching device 100 and is shown positioned near a barrier handle 32 and along a portion of the wall 26 and targeting a breach point 40 on the barrier 28. The position of the user 38 to a side of the barrier 28 (as shown) can provide some protection from hostile occupants within the region of access 36. This is because armed hostile occupants typically aim their weapons at the barrier 28. Once the barrier 28 is penetrated, an entourage of personal 3, typically having a ballistic barrier 34, can enter the region of access 36. After discussing FIGS. 2-5 that respectively follow, this detail description returns again to FIG. 1.

Figure 2:
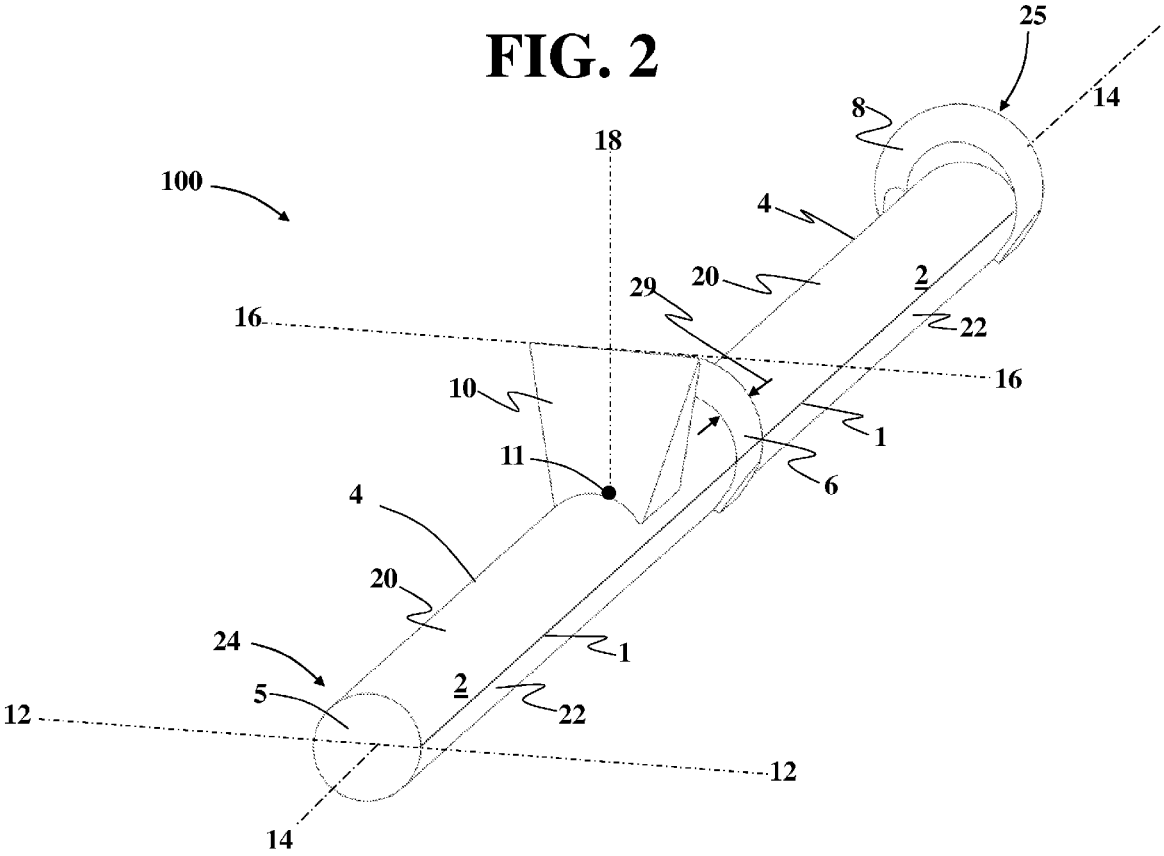
FIG. 2 is a perspective view of the breaching device.

FIG. 2 is a perspective view of the breaching device 100 depicted along a longitudinal axis or axial line 14 centered along the length of an elongated main body 4, which includes an outer surface 2. A top center line 18 extends through the elongated main body 4, and a top center point 11, and is transverse to the axial line 14. The top center line 18 is the reference line passing through a defined top of the breaching device 100. A dividing line 12 passes by the elongated main body 4 and is transverse to both the axial line 14 and the top center line 18. A plane comprising both the dividing line 12 and the axial line 14 divides the outer surface 2 of the elongated main body 4 into an upper 20 and lower 22 regions. A projection of a plane dividing the elongated main body 4 is referred to as a projection line 1 and depicts the boundary between the upper 22 and lower 22 regions of the outer surface 2. The elongated main body 4 can be made using round pipe made of steel, iron and the like.

A front cap 5 is a portion of the breaching device 100 used to contact the breach point 40 of the barrier 28 as discussed above in FIG. 1. The front cap 5 is disposed on a front end 24 of the elongated main body 4. The front cap 5 is typically made of strong materials such as steel, alloys of steel and the like. In one embodiment, the front cap 5 can be attached by welding to the entire circumference of the elongated main body 4. In another embodiment (not shown), the front cap 5 can be covered with materials having a high coefficient of friction or made of such materials, thereby reducing the opportunity of slippage of the breaching device 100 on contacting the barrier 28. Materials for reducing the slippage can include natural rubber, Line-X®, sleeved rubber and the like.

A back end 25, as depicted in FIG. 2, is the end opposite the front end 24 of the breaching device 100. An end cap (not shown) can be placed onto the back end 25 of the elongated main body 4 and can be attached similar to the front cap 5.

A curved handle 6 is shown in FIG. 2 connected to the elongated main body 4 on the outer surface 2. As shown in FIG. 2, the curved handle 6 can be made using round pipe having a diameter 29. The diameter of the curved handle 6 can range from about 1.25 inches to about 1.65 inches. The diameter needs to be of sufficient size and at least 1.25 inches to provide optimal gripping for the user 38 as mentioned in FIG. 1. The large diameter of the curved handle 6 provides a clear gripping advantage, thereby a typical person of large size (e.g., about 6 feet tall or taller) can obtain an optimal grip on the curved handle 6. The curved handle 6 extends above the upper region 20 of the breaching device 100.

A curved partition or partition 10 is disposed on the elongated main body 4 between the front end 24 and the curved handle 6. A substantial portion of the partition 10 is positioned generally along a line 16, which is perpendicular and parallel to the axial 14 and dividing 12 lines, respectively. In particular, the partition 10 is centered through the top center line 18 at the top center point 11. The partition 10 can be connected to the elongated main body 4 by welding, interference fitting, fasteners and the like. The method of connection should not be considered a limitation of the present invention.

A curved handle 8 is illustrated in FIG. 2 connected to the elongated main body 4 at two locations on the outer surface 2. The size and shape of the curved handle 8 is similar to the size and shape of the curved handle 6. The curved handle 8 is connected to the elongated main body 4 between the curved handle 6 and the back end 25. The method of connection of the curved handle 8 to the elongated main body is similar to the method of connection used for the curved handle 6.

Figure 2A:
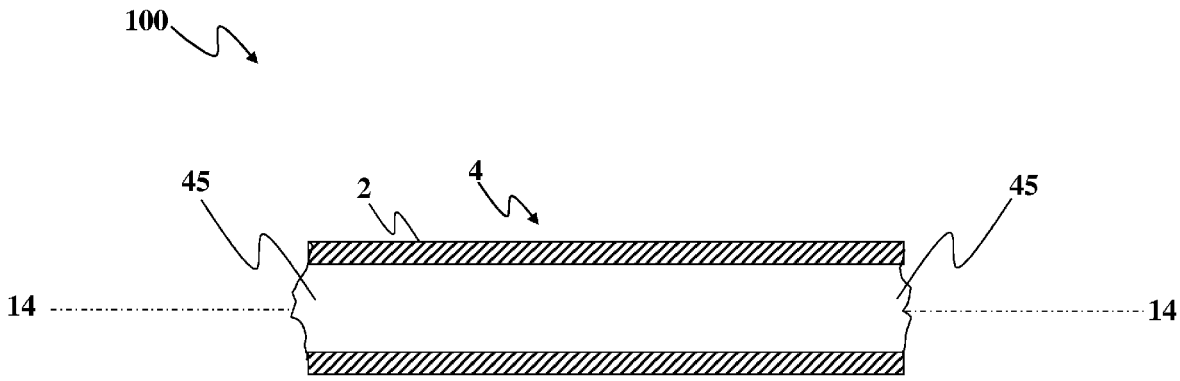
FIG. 2A is a cross section of a portion of the breaching device along an axial line.

FIG. 2A is a cross sectional view of a portion of the breaching device 100 along the axial line 14. The elongated main body 4 is depicted having an interior 45, which is void or empty and does not contain any material.

Figure 3:
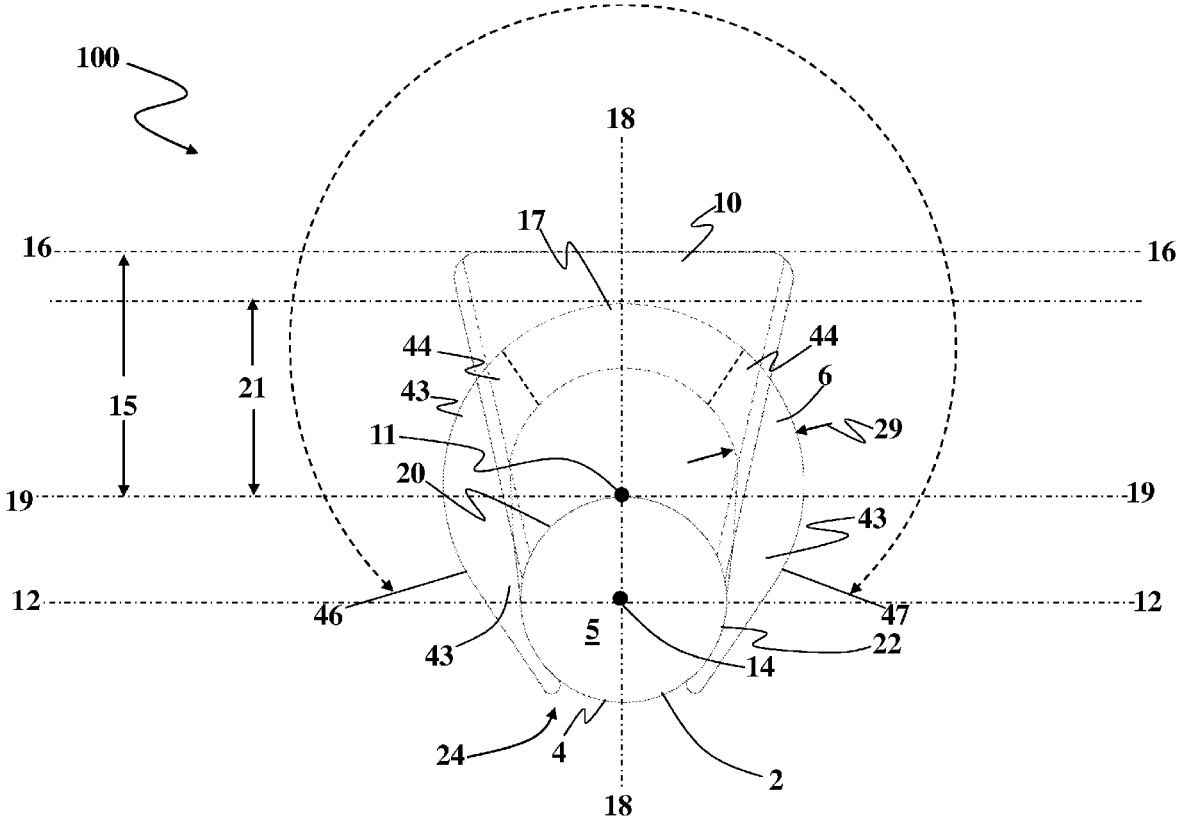
FIG. 3 is a front view of the breaching device as viewed from a front end along a longitudinal axis of the breaching device.

FIG. 3 is a front view of the breaching device 100 as viewed looking along the axial line 14, which extends along the length of the elongated main body 4. As illustrated in FIG. 3, the top center line 18 and the dividing line 12 intersect at the center of the elongated main body 4 or at the axial line 14 depicted as a point in this view. Only a portion of the curved handle 6 can be seen as viewed looking along the axial line 14, because the partition 10 blocks a portion of the curved handle 6. For this reason, the curved handle 6, as depicted in FIG. 3, includes exposed and hidden portions referred to as first 43 and second 44 portions, respectively. The first portion 43 of the curved handle 6 is depicted in FIG. 3 and is shown connected to the outer surface 2 of the elongated main body 4 at two locations. Generally, the curved handle 6 is connected at the lower portion 22 of the outer surface 2 or below the dividing line 12. A remaining or the second portion 44 of the curved handle 6 is depicted using hidden lines. A tangent line 19 is parallel to the dividing line 12 and passes through the top center point 11. The partition 10 extends a height 15 above the top center point 11 on the upper portion 20 of the outer surface 2. As shown in FIG. 3, the curved handle 6 extends a height 21 above the top center point 11 on the upper portion 20. Hence, as shown in FIG. 3, the partition 10 extends a height 15 greater than the height 21 of the curved handle 6. The partition 10 can extend above the curved handle 6 a distance in the range of about 1.25 inches to about 1.5 inches. Generally, the curved handle 6 is horse-shoe shaped and the ends are flattened, generally starting at points on the curved handle 6 at lines 46 and 47, as shown, and made substantially parallel with each other. The flattened portions of the curved handle 6 can be connected to the elongated main body 4 by welding, interference fitting, fasteners and the like. The method of connection should not be considered a limitation of the present invention. The shape of the curved handle 6 provides the user 38 an ergonomic advantage of maintaining a more natural wrist position. In one embodiment, the curved handle 6 can be shaped by bending to an inside diameter ranging from about 4.5 inches to about 4.6 inches. As shown in FIG. 3, this bending extends about 220 degrees between the lines 46 and 47.

In FIG. 3, a grip region 17 as viewed from the front end 24 along the line 14 is depicted on the hidden or second portion 44 of the curved handle 6 for the user 38 to grip the breaching device 100. Since the grip region 17 is hidden by the partition 10, the user's 38 hand is generally not exposed to any surfaces penetrated by or adjacent to the breaching device 100. This lack of exposure of the user's 38 hand is primarily due to the mechanical shielding provided by the partition 10.

Figure 4:
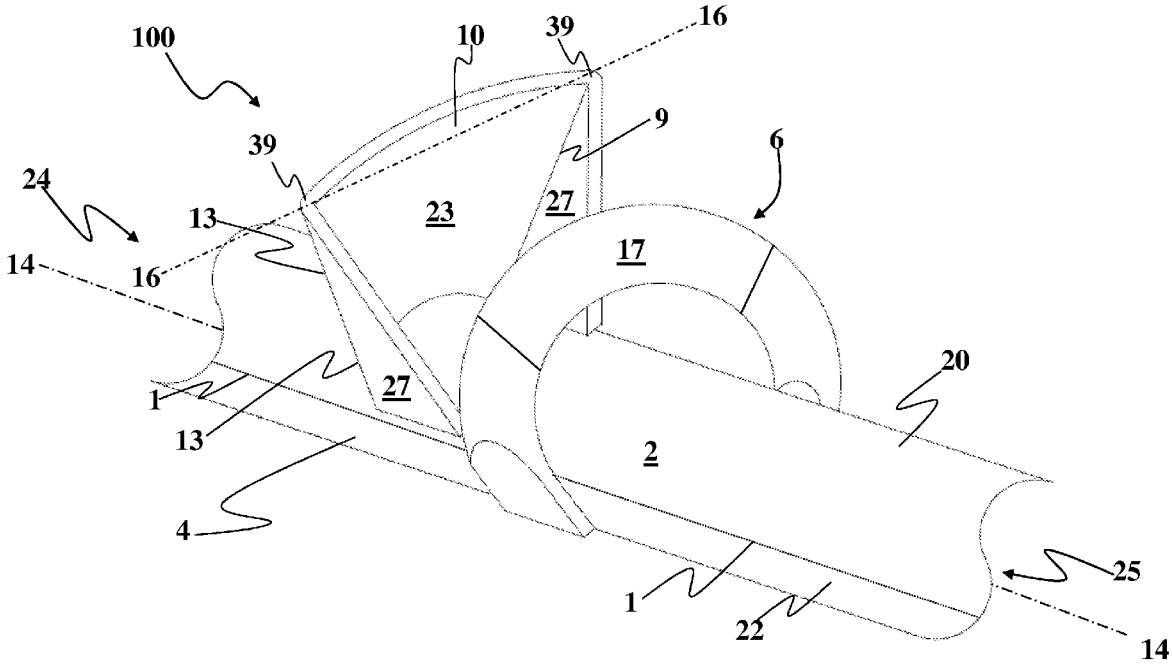
FIG. 4 is a perspective view of a portion of the breaching device.

FIG. 4 is a perspective view of a portion of the breaching device 100 as seen looking generally toward the front end 24. A portion of the elongated main body 4 is shown centered along the axial line 14. The partition 10, as depicted in FIGS. 2 and 3, further includes a main portion 23 and a pair of side portions 27. The main portion 23 is curved and intersects the line 16 at top corners 39 as depicted in FIG. 4. The main portion 23 is curved in order to provide an increase of protection by deflecting the kinetic energy outward toward the side portions 27. This provides an advantage similar to the well known "sloping armor effect". Further, the curved main portion 23 provides improved stability on impact.

The pair of side portions 27 and is positioned generally oblique to the main portion 23. Bends 9, 13 of the partition 10 are boundaries between the main portion 23 and the pair of side portions 27 and provides strength. The partition 10 including the pair of side portions 27 is shaped and positioned to generally shroud the curved handle 6 including the grip region 17. The partition 10 can be made using low carbon steel plate having a thickness ranging from about 0.25 inch to about 0.28 inch. The plate used to make the partition 10 can be rolled, bent and cut to provide the shape as depicted in FIG. 4.

Figure 5:
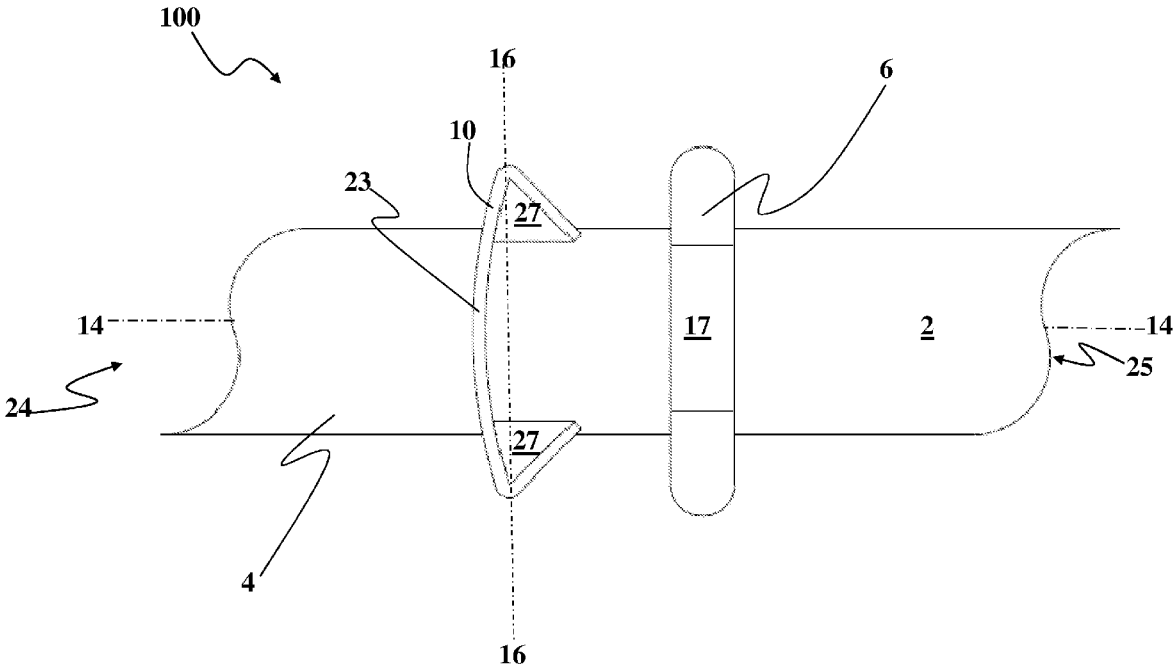
FIG. 5 is a top view of a portion of the breaching device.

FIG. 5 is a top view of a portion of the breaching device 100 and depicts the partition 10 in relation to the curved handle 6. The grip region 17 on the curved handle 6 is illustrated and can be covered with various materials to improve coefficient of friction between the 38 user's hand (FIG. 1) and the breaching device 100. The materials for covering the grip region can include at least natural rubber, knurling and adhesive aggregate. In using the breaching device 100, the motion just prior to impact is normally from the front end 24 to the back end 25. Hence, the partition 10 as shown in FIG. 5 is generally C-shaped and provides the advantage of forming a shield toward the direction of impact for the grip region 17.

Returning now to FIG. 1, the user 38 is shown swinging the breaching device 100 along an arc 7 having a center point 33, which is shown on a line 37 generally parallel to the length of the wall 26. The line 37 can be a distance from the wall 26 referred to as an offset 31. Generally, the center point 33 is adjacent to the wall 26. If the barrier 28 happens to be positioned next to a corner of two walls, it is understood that the point adjacent to the wall can be a point on a line 37 generally parallel to the width 37 of the barrier 28 and not in front of the barrier 28. The breaching device 100 impacts and penetrates the barrier 28 at the breach point 40. With momentum, the breaching device 100 continues to travel through the barrier 28 until the partition 10 impacts the wall 26 or jamb 35. Effectively, the partition 10 acts as a stop, thereby stopping the motion of the breaching device 100. Further, the partition 10 helps prevent exposing the user's 38 hand to nearby structures including the barrier 28, jamb 35 and wall 26, which is referred to as an adjacent surface.

Figure 6:
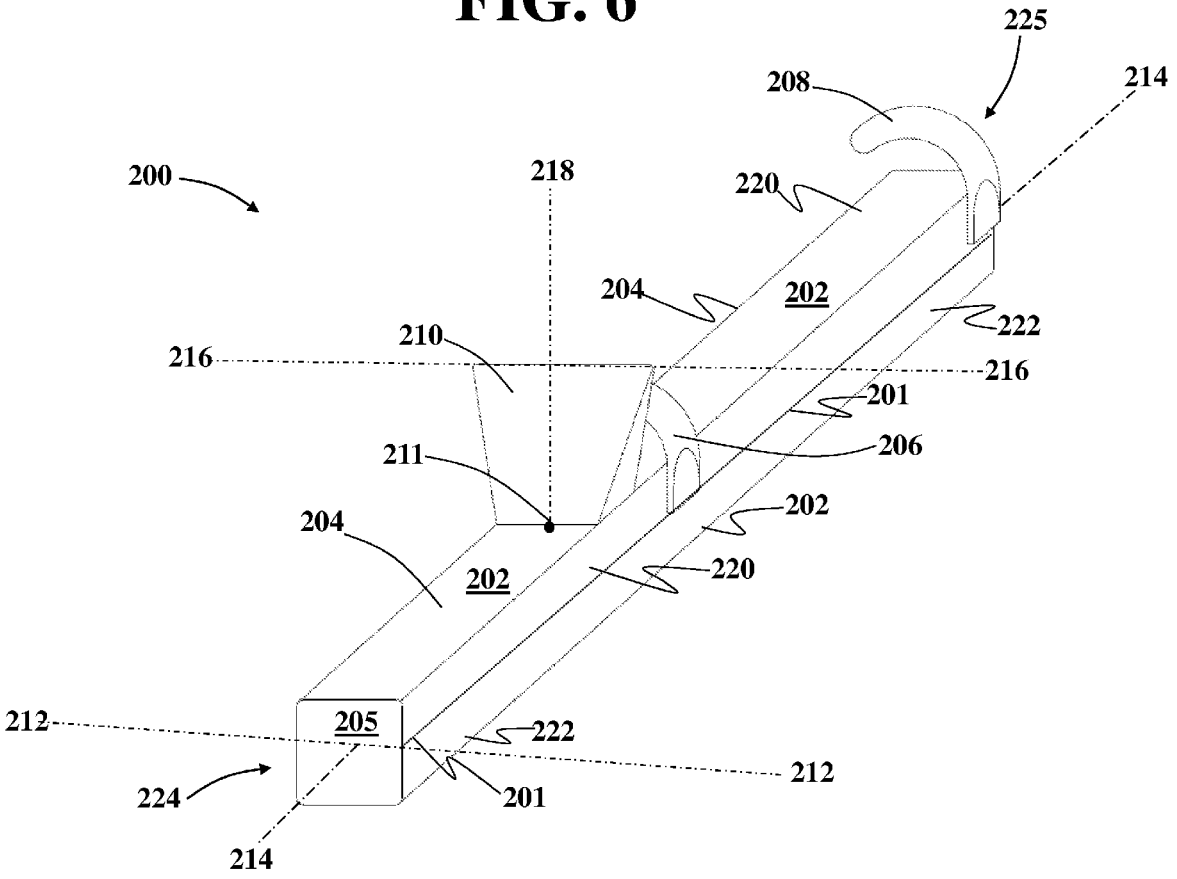
FIG. 6 is a perspective view of another embodiment of a breaching device.

FIG. 6 is a perspective view of the breaching device 200 depicted along a longitudinal axis or axial line 214 centered along the length of an elongated main body 204, which includes an outer surface 202. A top center line 218 extends through the elongated main body 204, and a top center point 211, and is transverse to the axial line 214. The top center line 218 is the reference line passing through the defined top of the breaching device 200. A dividing line 212 passes through the elongated main body 204 and is transverse to both the axial line 214 and the top center line 218. A plane comprising both the divide line 212 and the axial line 214 divides the outer surface 202 of the elongated main body 204 into an upper 220 and lower 222 regions. A projection of the plane is referred to as a projection line 201 and depicts the boundary between the upper 220 and lower 222 regions. The elongated main body 204 can be made using rectangular tube steel and the like.

A front cap 205 is the portion of the breaching device 200 used to contact the breach point 40 of the barrier 28 as discussed above in FIG. 1. The front cap 205 is disposed on a front end 224 of the elongated main body 204. The front cap 205 is typically made of similar materials to those discussed in FIG. 2 for the front cap 5. Further, the method of attachment of the front cap 205 is similar to the front cap of FIG. 2, except the welding is around the entire rectangular shape of the elongated main body 204

A back end 225, as depicted in FIG. 6, is the end opposite the front end 224 of the breaching device 200. An end cap (not shown) can be placed onto the back end 225 of the elongated main body 204 and can be attached similar to the front cap 5 discussed in FIG. 2.

A curved handle 206 is shown in FIG. 6 connected to the elongated main body 204 on outer surface 202. Though not shown, the curved handle 206 is connected at one location to the elongated main body 204. The connection of the curved handle 206 to the elongated main body can be made by welding, interference fitting, fasteners and the like. The method of connection should not be considered a limitation of the present invention. As depicted here in FIG. 6, the curved handle 206 is generally rounded in shape and having a diameter. The diameter of the curved handle 206 can be similar to the diameter of the curved handle 6 as discussed in FIG. 2.

A curved partition or partition 210 is disposed on the elongated main body 204 between the front end 224 and the curved handle 206. A substantial portion of the partition 210 is positioned generally along a line 216, which is perpendicular and parallel to the axial 214 and dividing 212 lines, respectively. In particular, the partition 210 is centered through the top center line 218 at the top center point 211. The partition 210 can be connected to the elongated main body 204 by welding, interference fitting, fasteners and the like.

A curved handle 208 is illustrated in FIG. 6 and connected to the elongated main body 204 at one location on the outer surface 202. The curved handle 208 is connected to the elongated main body 204 between the curved hand 206 and the back end 225. The method of connection of the curved handle 208 to the elongated main body is similar to the method of connection used for the curved handle 206. The size and shape of the curved handle 208 is similar to the size and shape of the curved handle 206.

Figure 6A:
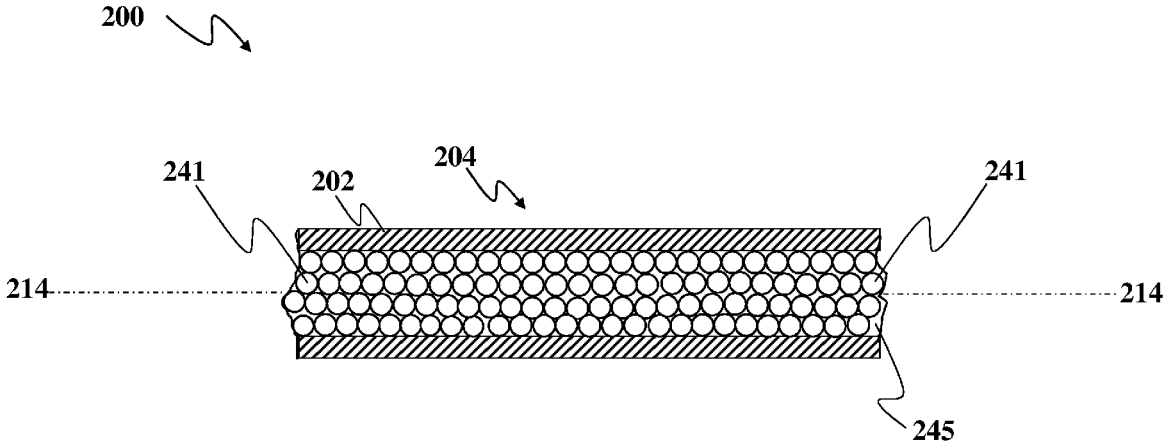
FIG. 6A is a cross section of a portion of the breaching device along an axial line.

FIG. 6A is a cross sectional view of a portion of the breaching device 200 along the axial line 214. The elongated main body 204 is depicted having an interior 245. Pellets 241 are shown contained within the interior 245. The pellets 241 can be made of materials including steel, tungsten, lead the like. The pellets 241 add weight to the breaching device 200 to help provide more weight on impacting the barrier 28.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A breaching device, comprising:

an elongated main body forming an outer surface and having a front end;

a fixed first curved handle having a grip region and attached to the outer surface and extends a first height over the outer surface and;

a fixed partition attached to the outer surface between the fixed first curved handle and the front end, and extends a second height over the outer surface, wherein the second height is greater than the first height such that the fixed first curved handle is substantially directly below the second height of the fixed partition, and the grip region is eclipsed by the fixed partition when viewed along the length of the elongated main body from the front end.

2. The device of claim 1, wherein the fixed partition is generally transverse to the length of the elongated main body.

3. The device of claim 2, wherein the grip region is eclipsed from view by the partition when viewed along the length of the elongated main body from the front end.

4. The device of claim 1, wherein the partition further comprises side portions.

5. The device of claim 1, wherein the fixed first curved handle is attached at more than one location to the outer surface.

6. The device of claim 1, further comprising a front cap disposed on the front end of the elongated main body.

7. The device of claim 1, further comprising a second curved handle attached to the outer surface and further from the front end than the fixed first curved handle.

8. The device of claim 1, wherein the partition is generally fan-shaped as viewed along the length of the elongated main body from the front end.

9. The device of claim 1, wherein the elongated main body comprises a cross sectional shape transverse to the length of the elongated main body and selected from the group of cross sectional shapes consisting of circular and rectangular.

10. A breaching device, comprising:

an elongated main body having an interior, an outer surface and a front end;

a plurality of pellets disposed within the interior;

a curved handle having a grip region and attached to the outer surface and;

a curved partition attached to the outer surface between the curved handle and the front end, wherein the curved partition is positioned with respect to the curved handle to substantially eclipse the grip region when viewed along the length of the elongated main body from the front end.

11. The device of claim 10, wherein the curved partition is a metal plate and generally transverse to the length of the elongated main body.

12. The device of claim 10, wherein the curved partition is generally C-shaped.

* * * * *